US008576044B2

(12) United States Patent
Chapman

(10) Patent No.: US 8,576,044 B2
(45) Date of Patent: Nov. 5, 2013

(54) HAND CONTROLLER FOR A CAMERA CRANE

(75) Inventor: Leonard T. Chapman, North Hollywood, CA (US)

(73) Assignee: Chapman/Leonard Studio Equipment, Inc., North Hollywood, CA (US)

( * ) Notice: Subject to any disclaimer, the term of this patent is extended or adjusted under 35 U.S.C. 154(b) by 9 days.

(21) Appl. No.: 13/289,828

(22) Filed: Nov. 4, 2011

(65) Prior Publication Data

US 2013/0113599 A1 May 9, 2013

(51) Int. Cl.
*H01C 10/00* (2006.01)

(52) U.S. Cl.
USPC ..... 338/68

(58) Field of Classification Search
USPC ..... 338/68, 78, 118
See application file for complete search history.

(56) References Cited

U.S. PATENT DOCUMENTS

| | | | | |
|---|---|---|---|---|
| 4,139,831 | A * | 2/1979 | Ortlieb et al. | 338/128 |
| 4,795,952 | A | 1/1989 | Brandstetter | |
| 4,843,200 | A | 6/1989 | Parlatore et al. | |
| 4,899,097 | A | 2/1990 | Chapman | |
| 5,107,955 | A * | 4/1992 | Kishi | 182/2.1 |
| 5,349,323 | A | 9/1994 | Shigemoto et al. | |
| 5,469,125 | A * | 11/1995 | Shigemoto et al. | 338/162 |
| 6,450,706 | B1 * | 9/2002 | Chapman | 396/428 |

FOREIGN PATENT DOCUMENTS

| | | |
|---|---|---|
| EP | 1657212 A2 | 5/2006 |
| GB | 312456 A | 5/1929 |

OTHER PUBLICATIONS

United States Patent and Trademark Office, International Search Report and Written Opinion for PCT/US12/060889, Jan. 23, 2013.

* cited by examiner

*Primary Examiner* — Kyung Lee
(74) *Attorney, Agent, or Firm* — Kenneth H. Ohriner; Perkins Coie LLP

(57) ABSTRACT

A controller for a camera crane has a rocker button pivotally supported in or on a controller housing about a first pivot axis. A shaft of an electrical component, such as a variable resistor, is on a second pivot axis spaced apart from the first pivot axis. An arm is attached to the shaft. A spring urges the arm to a center position. Movement of the rocker button moves the arm. Due to the offset of the first and second pivot axes, movement of the rocker button results in proportionally reduced movement of the shaft of the electronic component. Smooth crane arm movements are readily achieved as the controller is less sensitive to the operators hand or finger movements.

10 Claims, 8 Drawing Sheets

HAND CONTROLLER FOR A CAMERA CRANE

BACKGROUND OF THE INVENTION

Camera cranes are often used in motion picture and television production. The motion picture or television camera is typically mounted on a crane arm supported on a mobile base, dolly, or truck. Camera cranes generally have a crane arm supported on a base, with a camera platform at one end of the arm, and a counter weight at the other end. The crane arm can be pivoted by hand to raise and lower the camera, and also to pan to the left or right side.

Telescoping camera cranes have a telescoping arm that can extend and retract, providing far more capability than fixed length crane arms. The telescoping movement of the arm may be driven electrically or hydraulically. Generally, the crane operator uses a hand held controller to control the crane movement. The hand held controller is linked via a cable or wirelessly to the electrical or hydraulic drive system. Smooth movements reduce unwanted noise and stress on crane components. However, achieving smooth movements can be difficult to achieve, especially for less experienced crane operators. Accordingly, engineering challenges remain in designing an improved controller for a camera crane.

SUMMARY OF THE INVENTION

A new controller for a camera crane which overcomes the above-described factors has now been invented. In one aspect, this new controller includes a rocker button pivotally supported in or on a controller housing about a first pivot axis. A shaft of an electrical component, such as a variable resistor, is on a second pivot axis spaced apart from the first pivot axis. An arm is attached to the shaft. A spring urges the arm to a center position. Movement of the rocker button moves the arm. Due to the offset of the first and second pivot axes, movement of the rocker button results in proportionally reduced movement of the shaft of the electronic component. Smooth crane arm movements are readily achieved as the controller is less sensitive to the operators hand or finger movements.

In a second aspect, the rocker button may be linked to the arm via a pin on the rocker button extending into a slot on the shaft. In a third aspect, the electrical component may be contained within component housing, with the shaft extending out of the housing. A stop post on the component housing, and levers around the shaft, may optionally be provided to operate with the spring to continuously urge the arm into the center position.

In a third aspect, a recess may be provided in the controller housing with finger surfaces adjacent to the front and back ends of the recess. A dampening element may used to dampen return movement of the rocker button against the force of the spring. The invention resides as well in sub combinations of the features described.

BRIEF DESCRIPTION OF THE DRAWINGS

In the drawings, the same reference number indicates the same element in all of the views.

DETAILED DESCRIPTION OF THE DRAWINGS

Figure 1:
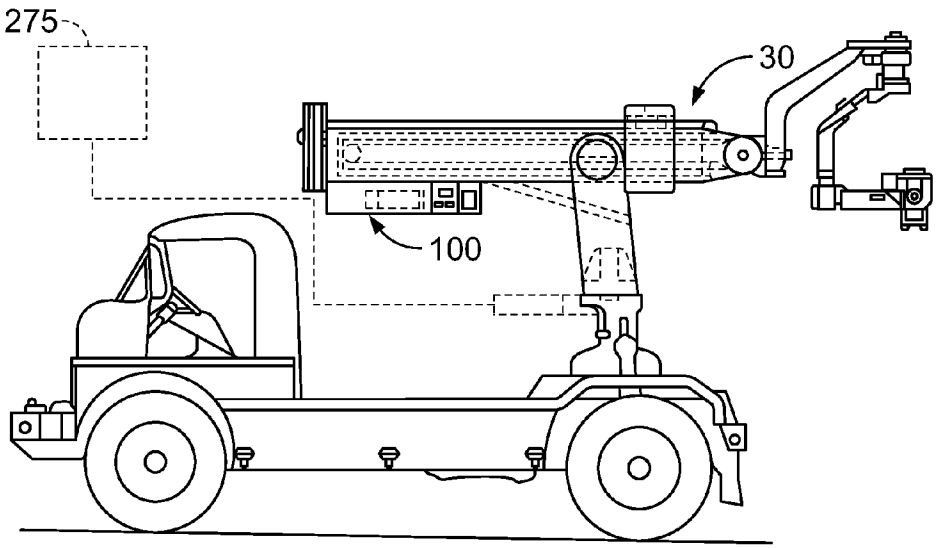
FIG. 1 is a side view of a camera crane with the crane arm retracted.
Figure 2:
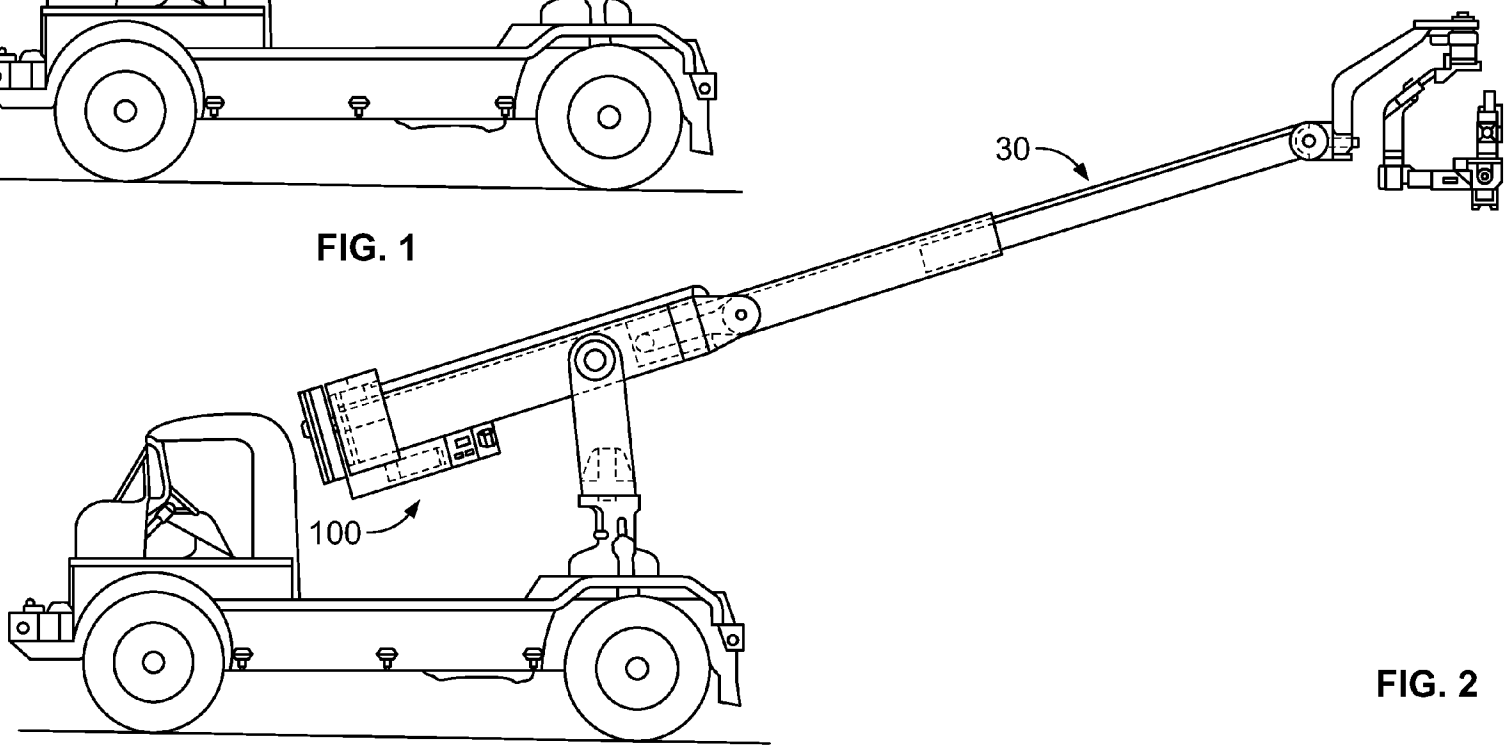
FIG. 2 is a side of the camera crane shown in FIG. 1 with the crane arm extended and angled up.
Figure 3:
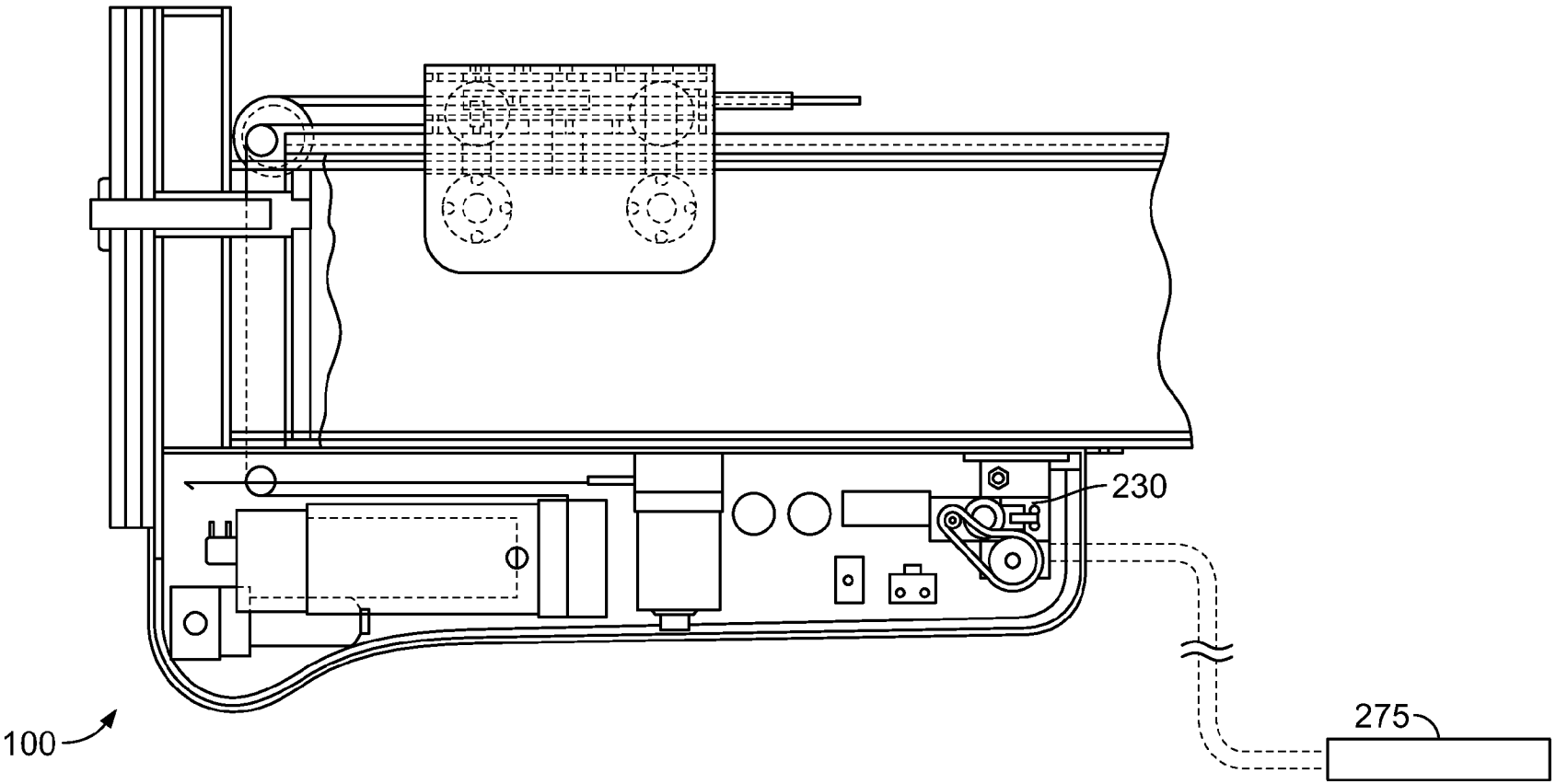
FIG. 3 is an enlarged section view of elements of the hydraulic system of the camera crane shown in FIGS. 1 and 2.

As shown in FIGS. 1 and 2, a hand controller 275 is connected to the hydraulic system 100 of a camera crane 30, via a cable or a wireless link. As shown in FIG. 3, the hydraulic system 100 includes a control valve 230 which controls telescoping movement of the camera crane 30, for example as describe in U.S. patent application Ser. Nos. 11/835,509 and 11/555,124, and U.S. Pat. No. 7,128,479, incorporated herein by reference.

Figure 4:
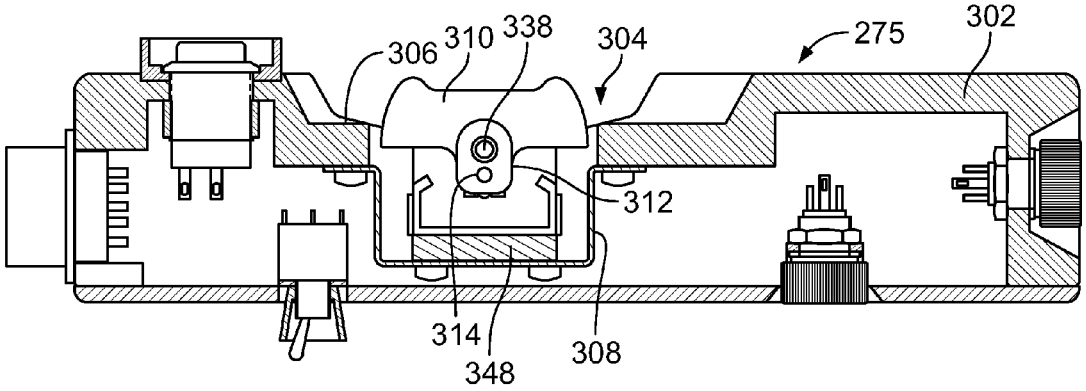
FIG. 4 is a side view in part section view of a hand controller that may be used with the camera crane shown in FIGS. 1-3.
Figure 5:
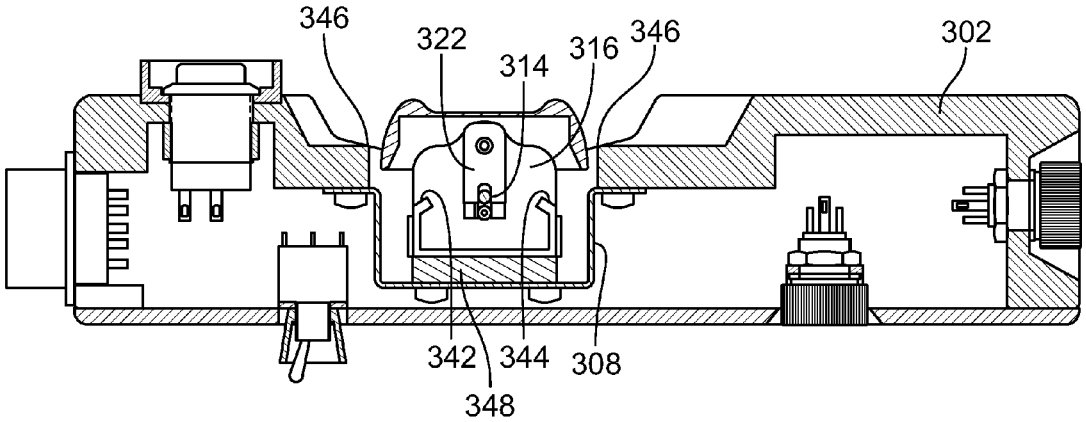
FIG. 5 is a section view of hand controller shown in FIG. 4.
Figure 6:
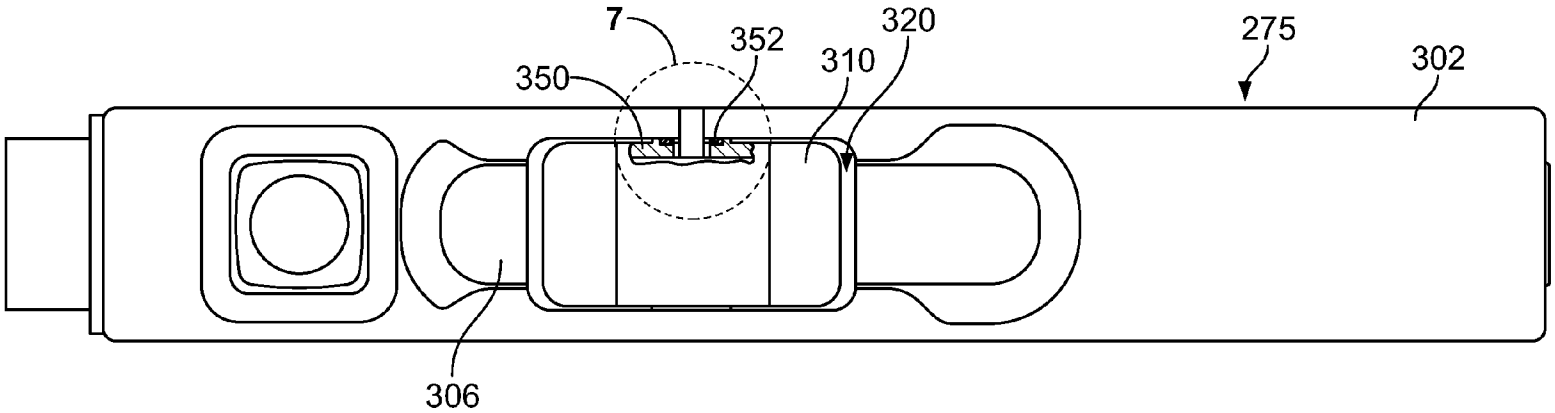
FIG. 6 is a top view of the hand controller shown in FIGS. 4 and 5.

Turning to FIGS. 4-6, the hand controller 275 typically includes an enclosure or box 302 having one or more electrical switches or other controls that may be linked to the hydraulic system or other component, wirelessly or via cables connected to connectors on the box. A rocker switch assembly 304 may be provided in the box 302 with a rocker button 310 pivotally supported on a shaft 338, and with the top of the rocker button extending up through an opening 320 in the box 302. As shown in FIG. 6, front and back finger surfaces 346 may be provided on opposite ends of the opening 320.

Figure 7:
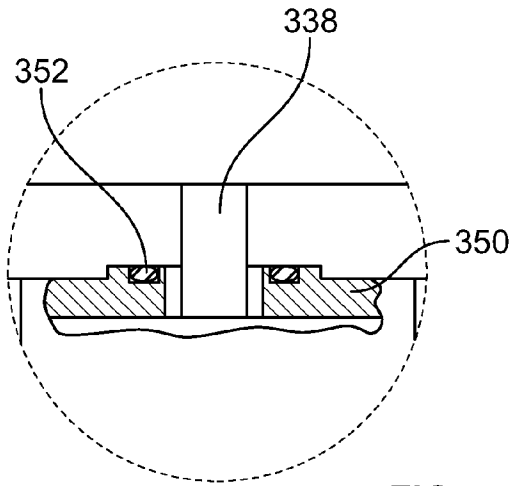
FIG. 7 is an enlarged section view detail of the rocker shaft shown in FIG. 6.
Figure 8:
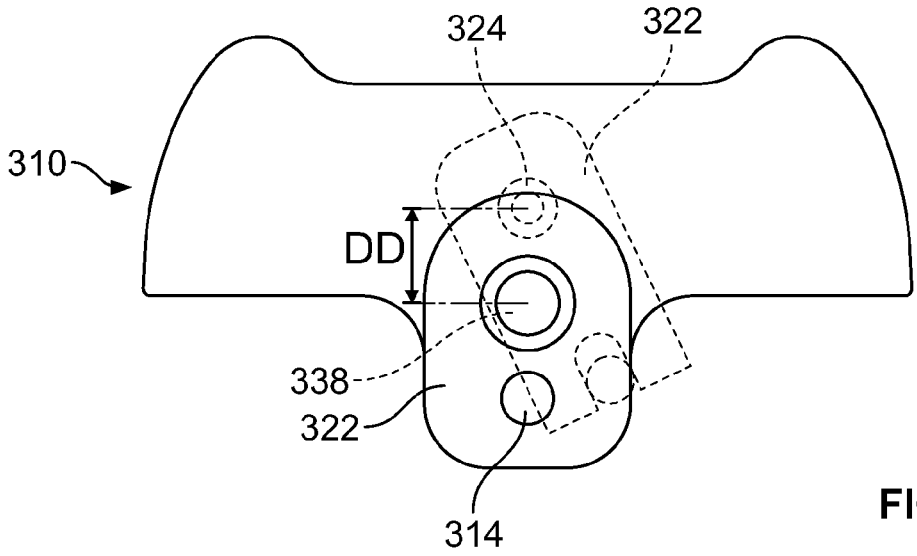
FIG. 8 is a left side view of the rocker button.
Figure 9:
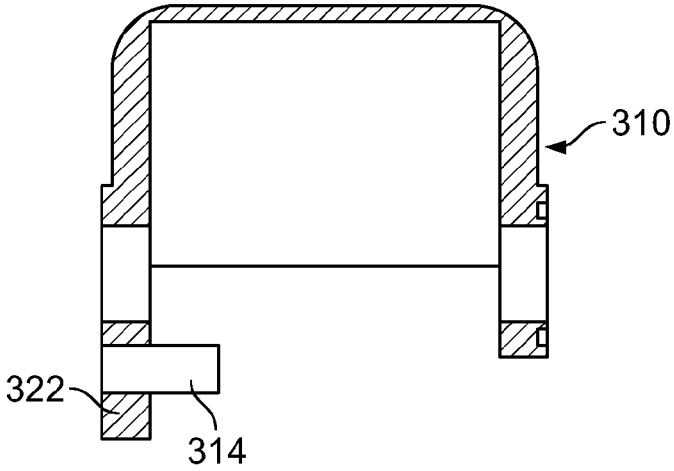
FIG. 9 is a section view of the rocker button shown in FIG. 8.
Figure 10:
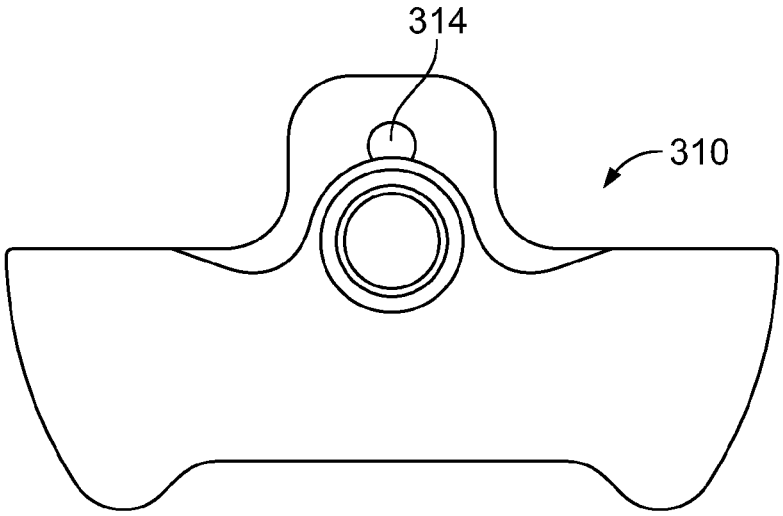
FIG. 10 is a right side view of the rocker button shown in FIGS. 8 and 9.
Figure 11:
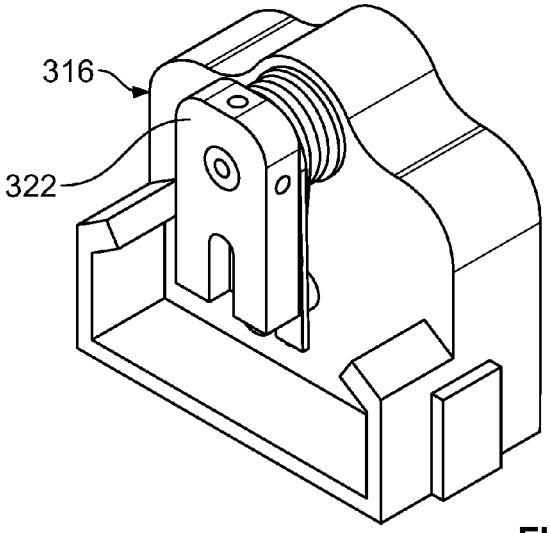
FIG. 11 is a perspective view of the potentiometer assembly shown in FIG. 5.
Figure 12:
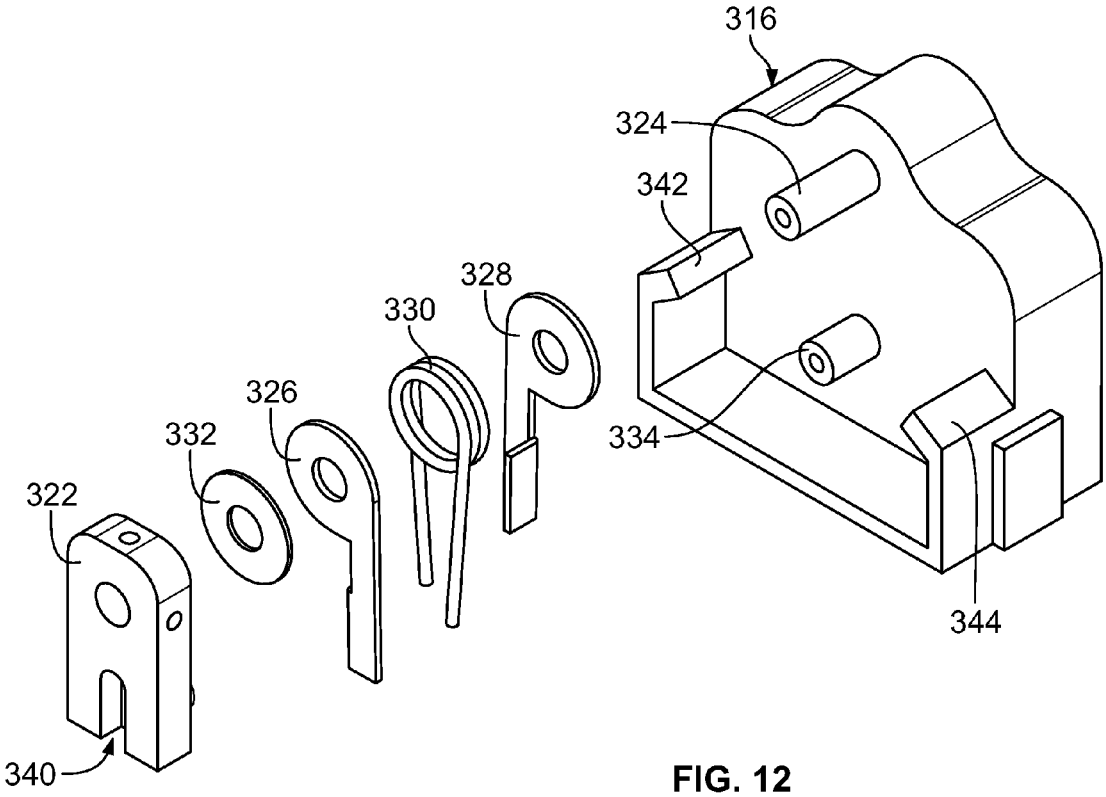
FIG. 12 is a perspective view of the potentiometer housing shown in FIG. 11.
Figure 13:
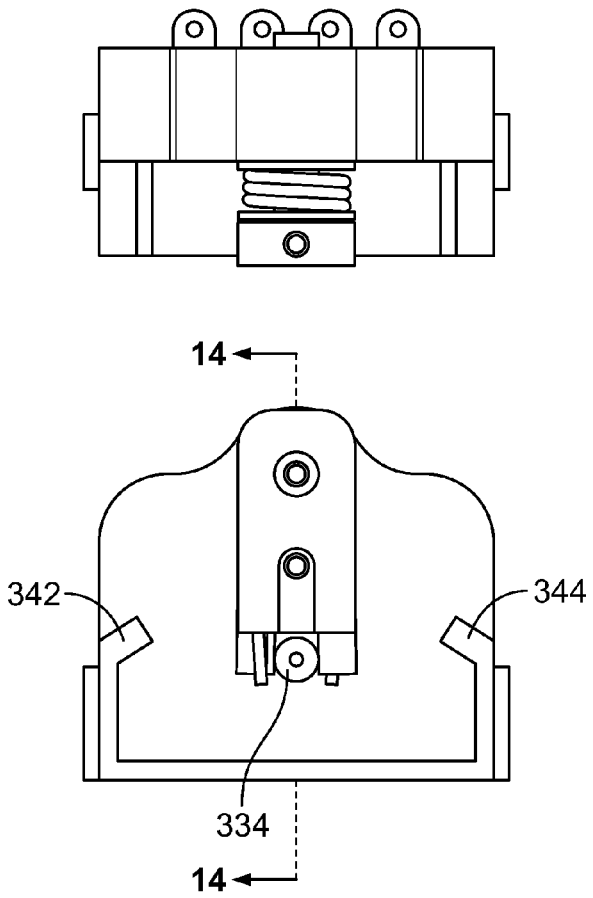
FIG. 13 is a side view of the potentiometer assembly shown in FIG. 11.
Figure 14:
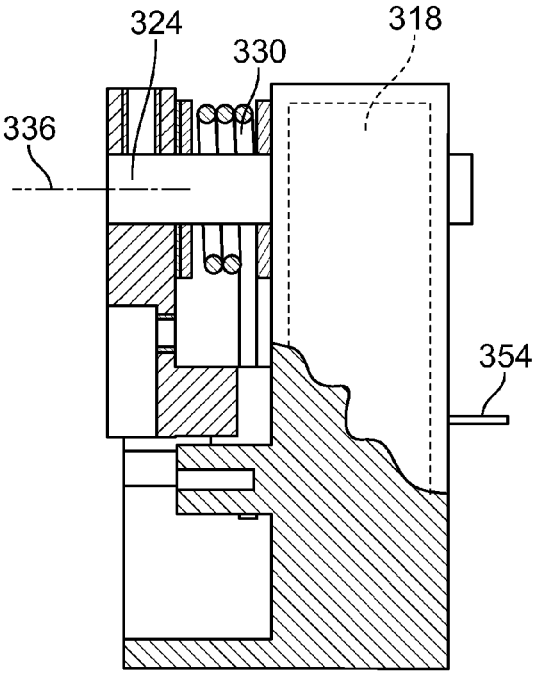
FIG. 14 is a section view taken along line A-A of FIG. 13.

The rocker switch assembly 304 may include a bracket 308 attached to the box 302, and a switch housing 316 attached to the bracket 308. A spacer 348 may be attached to the bracket to set the vertical position of the rocker switch assembly 304. Referring to FIG. 7, a low friction washer 350, such as a Teflon (fluorine resins) washer can be positioned around the shaft 338, with a resilient element 352, such as a rubber O-ring between the washer 350 and a sidewall of the box 302. Turning to FIGS. 8-10, the rocker button 310 is pivotally supported on the rocker shaft 338. The washer 350 and the resilient element 352 add drag to movement of the rocker button 310, to dampen rocker button movements. A rocker pin 314 is attached to an extension arm 322.

As shown in FIGS. 11-14, a shaft 324 of a variable resistor 318 extends out of the switch housing 316. Levers 326 and 328, a spring 330 and a washer 332 are positioned around the shaft. An arm 322 is rigidly attached to the shaft 324. The spring 330 and the arms 326 and 328 act to urge the arm 322 toward a center position, with the arms pressing against a center post 334 on the switch housing 316. Electrical contacts 354 extend out of the back of the switch housing 316, for making electrical connections to the variable resistor 318 within the switch housing. A slot 340 at the lower end of the arm 322 is dimensioned to fit around the rocker pin 314.

Referring to FIGS. 5 and 8, the shaft 324 of the variable resistor 318 is positioned by dimension DD above the rocker shaft 338. The rocker pin 314 extends into the slot 340 of the arm 322. Consequently, rotation or pivoting of the rocker button 310 correspondingly rotates the arm 322 about the shaft 324. However, due to the offset between the shafts 324 and 338, rotation of the shaft 324 is only a fraction of the rotation of the shaft 338.

Figure 15:
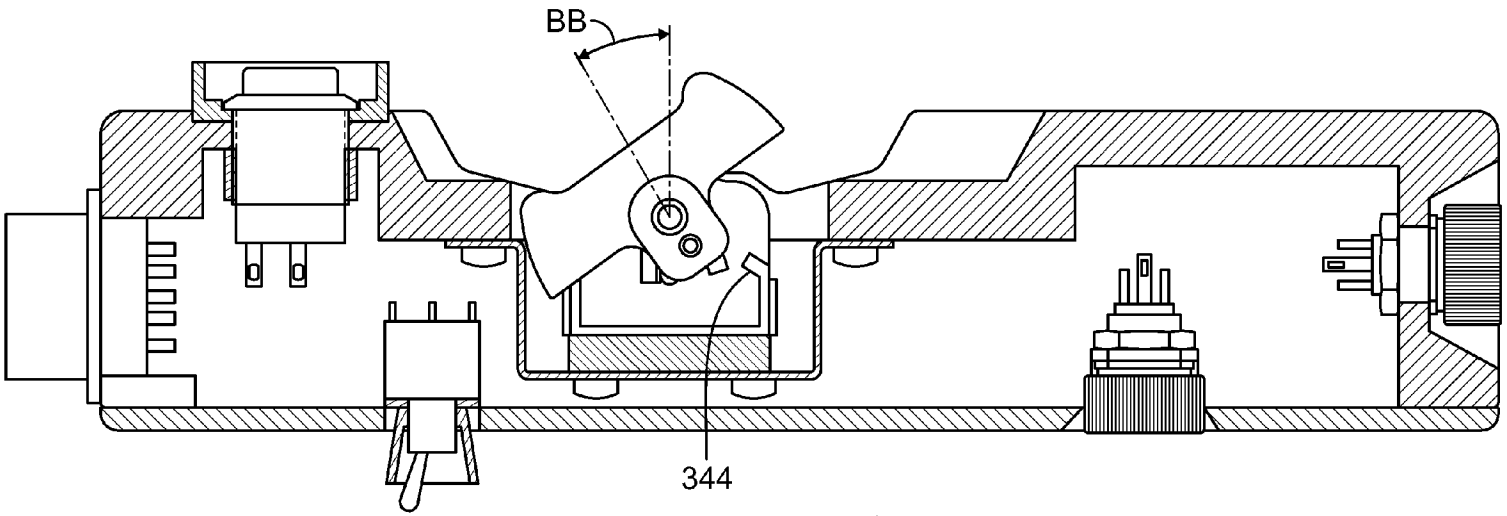
FIG. 15 is a section view similar to FIG. 4 showing the rocker button in a full up or forward movement position.
Figure 16:
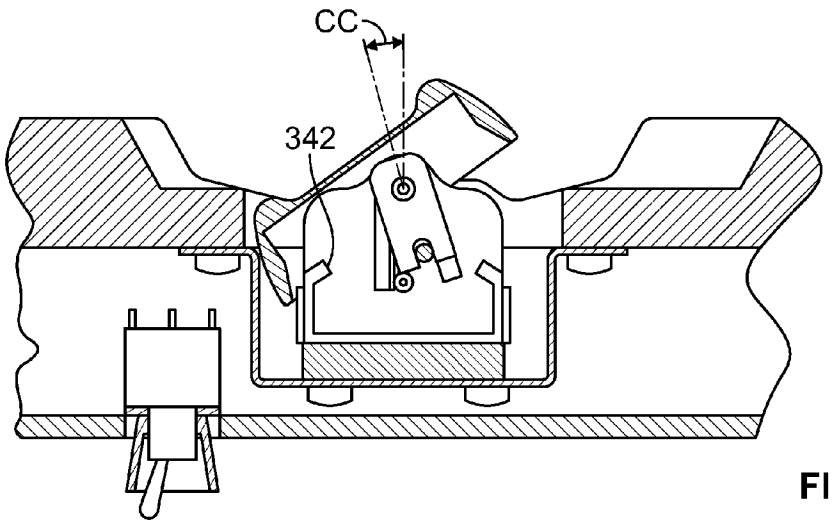
FIG. 16 is a section view similar to FIG. 5 showing the rocker button in a full up or forward movement position, and proportionally reduced movement of the potentiometer shaft.

When a user presses the front end of the rocker button 310 into the full down position, as shown in FIG. 15, the rocker button 310 bottoms out against a stop ledge 342 on the switch housing 316. The rocker button rotates through an angle BB from a center or neutral position to the maximum forward position. The angle BB can vary in different designs. In the example shown angle BB is about 36 degrees. Due to the geometry described above, the shaft 324 of the variable resistor rotates through a smaller angle CC, for example about 18 degrees. The controller 275 is accordingly de-sensitized because the physical movement of the rocker button 310 result in a proportionally reduced change in the resistance of the variable resistor, and correspondingly proportionally reduced movement of the crane arm. The rotation reducing mechanical linkage between rocker button and the variable resistor makes smooth control of the crane easier to achieve, even for less experienced crane operators.

When the rocker button is released, the spring 330 urges the button back to the center position. The drag provided by the resilient member 352 prevents the rocker button from snapping quickly back to center. Rather, due to the drag, when released, the rocker button rotates smoothly back to center with no overshoot. This avoids erratic or jerking movement of the crane arm. Noise and stress on crane arm components are reduced or eliminated, even when the crane arm is operated by less experienced personnel.

As shown in FIGS. 15-18, the rocker button 310 may be designed so that the top of front end of the button is about flush with the surface of the box 302 at the recess 306 when the bottom of the rocker button contacts the forward stop 342. This provides the operator with a tactile indicator that the rocker button has reached its forward limit of travel. The features and operations described above apply as well to rearward movement of the rocker button, i.e., when the user presses down on the back end of the rocker button. The variable resistor may be replaced by other electronic components, such as an amplifier, which can covert the physical movement of the rocker button into electrical signals.

Thus, novel designs and methods have been shown and described. Various changes and modifications may of course be made without departing from the spirit and scope of the invention. The invention, therefore, should not be limited except by the following claims, and their equivalents.

The invention claimed is:

1. A hand controller, comprising:

a controller housing;

a rocker button pivotally supported on the housing on a first pivot axis;

a variable resistor having a shaft on a second pivot axis spaced apart from the first pivot axis;

a cable or wireless link connecting an output of the variable resister to a hydraulic system;

an arm attached to the shaft, with a slot in a lower end of the arm;

a spring biasing the arm to a center position; and a pin on the rocker button extending into the slot, with movement of the rocker button through a first angle rotating the shaft through a second angle less than the first angle.

2. The hand controller of claim 1 further comprising a shaft housing, with the variable resistor inside of the shaft housing and with the shaft extending out of the shaft housing, a stop post on the shaft housing, and first and second levers pivotally attached to the shaft and based by the spring to urge the arm into the center position.

3. The hand controller of claim 1 further a shaft housing, with the variable resistor inside of the shaft housing and with the shaft extending out of the shaft housing, and an up stop ledge and a down stop ledge on the shaft housing.

4. The hand controller of claim 3 with the rocker button having an upper and a lower first end and an upper and a lower second end, and further comprising:

a recess in the controller housing having first end second ends;

first and second finger surfaces adjacent to the upper first and second ends of the recess;

the upper first end of the rocker switch substantially flush with the first finger surface when the lower first eon of the rocker switch contacts the up stop ledge.

5. A hand controller, comprising:

a controller housing having a top surface;

a rocker button pivotally supported on the housing on a first pivot axis;

a variable resistor having a shaft on a second pivot axis spaced apart from and above the first pivot axis;

a cable or wireless link for providing an output signal of the variable resistor to a hydraulic system of a camera crane;

a spring biasing the arm to a center position; and an angular movement reducing mechanical linkage connecting the rocker button to the shaft causing movement of the rocker button through a first angle to turn the shaft through a second angle less than the first angle.

6. The controller of claim 5 with the mechanical linkage comprising an arm attached to the shaft, and a pin slidably connecting the rocker button to the arm.

7. The hand controller of claim 5 where spacing between the first and second pivot axes is selected to cause pivoting of the rocker button through an angle AA to pivot the shaft through an angle of 20% to 80% of AA.

8. A hand controller for hydraulic system, comprising:

a hand-held controller housing;

a rocker button pivotally supported on the housing on a first pivot axis;

a variable resistor in a variable resistor housing, with the variable resistor having a shaft on a second pivot axis spaced apart from the first pivot axis, with the variable resistor electrically linked to a control valve in the hydraulic system;

an arm attached to the shaft with a slot in a lower end of the arm and a pin on the rocker button extending into the slot forming an angular movement reducing mechanical linkage connecting the rocker button to the shaft, causing movement of the rocker button through a first angle to turn the shaft through a second angle less than the first angle;

a spring biasing the arm to a center position;

a stop post on the variable resistor housing;

first and second levers pivotally attached to the shaft and biased by the spring to urge the arm into the center position.

9. The hand controller of claim 8 with the variable resistor electrically linked to the control valve via a cable connected to the controller housing.

10. The hand controller of claim 8 with the variable resistor electrically linked to the control valve via a wireless link in controller housing.

* * * * *